US006197462B1

(12) United States Patent
Yanus et al.

(10) Patent No.: US 6,197,462 B1
(45) Date of Patent: Mar. 6, 2001

(54) CROSS-LINKED POLYAMIDE ANTICURL BACK COATING FOR ELECTROSTATOGRAPHIC IMAGING MEMBERS

(75) Inventors: John F. Yanus, Webster; Timothy J. Fuller, Pittsford; Damodar M. Pai, Fairport; William W. Limburg, Penfield; John A. Bergfjord, Sr., Macedon; Dale S. Renfer, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/450,196

(22) Filed: Nov. 29, 1999

(51) Int. Cl.[7] ..... G03G 5/10
(52) U.S. Cl. ..... 430/56; 430/69
(58) Field of Search ..... 430/58.3, 58.8, 430/66, 67, 69, 56

(56) References Cited

U.S. PATENT DOCUMENTS

| | | | | |
|---|---|---|---|---|
| 5,368,967 | | 11/1994 | Schank et al. | 430/59 |
| 5,681,679 | | 10/1997 | Schank et al. | 430/59 |
| 5,702,854 | | 12/1997 | Schank et al. | 430/59 |
| 5,709,974 | | 1/1998 | Yuh et al. | 430/59 |
| 5,725,983 | | 3/1998 | Yu | 430/58 |
| 5,976,744 | * | 11/1999 | Fuller et al. | 430/58.8 |
| 6,004,709 | * | 12/1999 | Renfer et al. | 430/58.3 |
| 6,025,102 | * | 2/2000 | Pai et al. | 430/58.8 |

* cited by examiner

*Primary Examiner*—John Goodrow
(74) *Attorney, Agent, or Firm*—John L. Haack

(57) ABSTRACT

A flexible electrostatographic imaging member including at least one photographic imaging layer, a support layer, and an anticurl back layer having an exposed surface including a cross linked polyamide at the exposed surface, the polyamide being, formed from a solution selected from the group including a first solution including crosslinkable alcohol soluble polyamide containing methoxy methyl groups attached to amide nitrogen atoms, an acid having a $pK_a$ less than about 3, a cross linking agent selected from the group including a formaldehyde generating cross linking agent, an alkoxylated cross linking agent, a methylolamine cross linking agent and mixtures thereof, and a liquid selected from the group including alcohol solvents, diluent and mixtures thereof, a second solution including crosslinkable alcohol soluble polyamide free of methoxy methyl groups attached to amide nitrogen atoms, an acid having a $pK_a$ less than about 3, a cross linking agent selected from the group including a an alkoxylated cross linking agent, a methylolamine cross linking agent and mixtures thereof, and a liquid selected from the group including alcohol solvents, diluent and mixtures thereof.

8 Claims, No Drawings

CROSS-LINKED POLYAMIDE ANTICURL BACK COATING FOR ELECTROSTATOGRAPHIC IMAGING MEMBERS

BACKGROUND OF THE INVENTION

This invention relates in general to electrostatography and, more specifically, to an improved electrostatographic imaging member comprising a cross linked polyamide coating in an anticurl back layer.

Electrostatographic imaging members are well known. Typical electrophotographic imaging members include photosensitive members (photoreceptors) that are commonly utilized in electrophotographic (xerographic) processes in either a flexible belt or a rigid drum configuration. The electrophotographic imaging member may also be a flexible intermediate transfer belt. The flexible belt may be seamless or seamed. These belts are usually formed by cutting a rectangular sheet from a web, overlapping opposite ends, and welding the overlapped ends together to form a welded seam. These electrophotographic imaging members comprise a photoconductive layer comprising a single layer or composite layers. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer, the photoconductive layer is sandwiched between a contiguous charge transport layer and the supporting conductive layer. Alternatively, the charge transport layer may be sandwiched between the supporting electrode and a photoconductive layer. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a charge generating layer, a charge transport layer and a conductive ground strip layer adjacent to one edge of the imaging layers, and an optional overcoating layer. This photoreceptor usually comprises an anticurl back coating on the side of the substrate opposite the side carrying the conductive layer, support layer, blocking layer, adhesive layer, charge generating layer, charge transport layer and other layers.

After application of the coatings for multilayered organic photoconductors, the resulting web tends to spontaneously curl when the coating solvents evaporate. Curl is primarily due to dimensional contraction of the applied charge transport layer coating from the point in time when the applied charge transport layer coating solidifies and adheres to the underlying surface. Once this solidification and adhesion point is reached, further evaporation of coating solvent causes continued shrinking of the applied charge transport layer coating due to volume contraction. Removal of additional solvent will cause the coated web to curl toward the applied charge transport layer, because the substrate (usually polyethylene terephthalate) does not undergo any dimensional changes. This shrinking occurs isotropically, i.e., three-dimensionally. Curling of a photoreceptor web is undesirable because it hinders fabrication of the web into cut sheets and subsequent welding into a belt. An anticurl back coating layer having a curl equal to and in the opposite direction to the applied layers is applied to eliminate the overall curl of the coated device. However, the anticurl back coating introduces its own problems. The anticurl coating introduces mechanical stresses which, when perturbed by wear, results in distortions resembling ripples. These ripples are the most serious photoreceptor related problem in advanced highly sophisticated imaging machines that demand precise tolerances. When ripples are present, different segments of the imaging surface of the photoconductive member are located at different distances from charging devices, developer applicators, toner image receiving members, and the like, during the electrophotographic imaging process. The quality of the ultimate developed images is thereby adversely affected. For example, nonuniform charging distances can be manifested as variations in high background deposits during development of electrostatic latent images. It is theorized that since the anticurl backing layer is usually composed of material that is less wear resistant than the adjacent substrate layer, it wears rapidly during extended image cycling, particularly when supported by stationary skid plates. This wear is nonuniform, and not only causes the distortions called ripples, but also produces debris which can form undesirable deposits on sensitive optics, corotron wires, and the like. The debris also coats the rollers and creates flatness problems. Ripple formation is due to the critical balance between the stress causing curl, which is established when the xerographically active layers are coated, and the counter stress which develops when the anticurl back layer is coated. Although the photoreceptor lies flat, it is not stress free, but is stress compensated. Wear of the anticurl back layer, especially if that wear is uneven, will cause a deformation in the process direction and that distortion is called ripple.

INFORMATION DISCLOSURE STATEMENT

U.S. Pat. No. 5,725,983 to Yu, issued Mar. 10, 1998—An electrophotographic imaging member is disclosed including a supporting substrate having an electrically conductive layer, a hole blocking layer, an optional adhesive layer, a charge generating layer, a charge transport layer, an anticurl back coating, a ground strip layer and an optional overcoating layer, at least one of the charge transport layer, anticurl back coating, ground strip layer and the overcoating layer comprising a blend of inorganic and organic particles homogeneously distributed in a film forming matrix in a weight ratio of between about 3:7 and about 7:3, the inorganic particles and organic particles having a particle diameter less than about 4.5 micrometers. These electrophotographic imaging members may have a flexible belt form or rigid drum configuration. These imaging members may be utilized in an electrophotographic imaging process.

U.S. Pat. No. 5,368,967 to R. Schank et al., Nov. 29, 1994—An electrophotographic imaging member is disclosed comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups of the hydroxy arylamine and the hydroxy or multihydroxy triphenyl methane. This overcoat layer may be fabricated using an alcohol solvent. This electrophotographic imaging member may be utilized in an electrophotographic imaging process.

U.S. Pat. No. 5,681,679 to R. Schank et. al., Oct. 28, 1997—A flexible electrophotographic imaging member is disclosed including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 5,709,974 to H. Yuh et. al., Jan. 20, 1998—An electrophotographic imaging member is disclosed including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

U.S. Pat. No. 5,702,854 to Shank et al. Dec. 30, 1997—An electrophotographic imaging member is disclosed including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

CROSS REFERENCE TO COPENDING APPLICATIONS

U.S. patent application Ser. No. 09/429,387, entitled "IMAGING MEMBER WITH PARTIALLY CONDUCTIVE OVERCOATING", filed in the names of Fuller et al. on Oct. 28, 1999, (Attorney Docket No. D/99403)—An electrophotographic imaging member is disclosed including at least one photographic imaging layer and a partially electrically conductive overcoat layer including finely divided charge injection enabling particles dispersed in a charge transporting continuous matrix including a cross linked polyamide, charge transport molecules and oxidized charge transport molecules, the continuous matrix being formed from a solution selected from the group including a first solution including cross linkable alcohol soluble polyamide containing methoxy methyl groups attached to amide nitrogen atoms, an acid having a $pK_a$ of less than about 3, a cross linking agent selected from the group comprising a formaldehyde generating cross linking agent, an alkoxylated cross linking agent, a methylolamine cross linking agent and mixtures thereof, a dihydroxy arylamine, and a liquid elected from the group including alcohol solvents, diluent and mixtures thereof, a second solution including cross linkable alcohol soluble polyamide free of methoxy methyl groups attached to amide nitrogen atoms, an acid having a $pK_a$ of less than about 3, an alkoxylated cross linking agent, a methylolamine cross linking agent and mixtures thereof, a dihydroxy arylamine, and a liquid selected from the group including alcohol solvents, diluent and mixtures thereof. An electrophotographic imaging process is also disclosed.

U.S. patent application Ser. No. 09/450,189, entitled "CROSS LINKED PHENOXY ANTICURL BACK COATING FOR ELECTROSTATOGRAPHICIMAGING MEMBERS", filed in the names of Yanus et al. concurrently herewith, A flexible electrostatographic imaging member is disclosed including at least one photographic imaging layer, a support layer, and an anticurl back layer having an exposed surface including a cross linked phenoxy resin at the exposed surface, the phenoxy resin being formed from a solution including cross linkable solvent soluble phenoxy resin containing hydroxyl groups attached to carbon atoms, an acid having a $pK_a$ less than about 3, a cross linking agent selected from the group including a formaldehyde generating cross linking agent, an alkoxylated cross linking agent, a methylolamine cross linking agent and mixtures thereof, and a liquid selected from the group including solvents, diluent and mixtures thereof.

While the above mentioned electrostatographic imaging members may be suitable for their intended purposes, there continues to be a need for improved imaging members, particularly for modified multilayered electrostatographic imaging members in a flexible belt configuration having an improved anticurl back coating layer.

BRIEF SUMMARY OF THE INVENTION

It is, therefore, an object of the present invention to provide improved layered electrostatographic imaging members which overcome the above noted disadvantages.

It is another object of the present invention to provide an improved layered electrostatographic imaging member which exhibits resistance to curl after extended use in imaging systems.

It is still another object of the present invention to provide an improved layered electrostatographic imaging member which avoids collisions with closely adjacent imaging subsystems.

It is yet another object of the present invention to provide an improved layered electrostatographic imaging members having a coating on an anticurl backing layer.

It is another object of the present invention to provide a coating on an anticurl backing layer that is tough and wear resistant.

It is still another object of the present invention to provide a coating on an anticurl backing layer that is abrasion resistant.

It is another object of the present invention to provide a coating on an anticurl backing layer that eliminates ripple.

It is yet another object of the present invention to provide an improved layered electrostatographic imaging members which reduces debris within the machines.

The foregoing objects and others are accomplished in accordance with this invention by providing a flexible electrostatographic imaging member comprising at least one photographic imaging layer, a support layer, and an anticurl back layer having an exposed surface comprising a cross linked polyamide at the exposed surface, the polyamide being formed from a solution selected from the group comprising a first solution comprising cross linkable alcohol soluble polyamide containing methoxy methyl groups attached to amide nitrogen atoms, an acid having a $pK_a$ less than about 3, a cross linking agent selected from the group comprising a formaldehyde generating cross linking agent, an alkoxylated cross linking agent, a methylolamine cross linking agent and mixtures thereof, and a liquid selected from the group comprising alcohol solvents, diluent and mixtures thereof, a second solution comprising cross linkable alcohol soluble polyamide free of methoxy methyl groups attached to amide nitrogen atoms, an acid having a $pK_a$ less than about 3, a cross linking agent selected from the group comprising a an alkoxylated cross linking agent, a methylolamine cross linking agent and mixtures thereof, and a liquid selected from the group comprising alcohol solvents, diluent and mixtures thereof.

For reasons of convenience, the invention will be described for electrophotographic imaging members in flexible belt form even though this invention includes electrostatographic imaging members having similar configurations.

Electrostatographic flexible belt imaging members are well known in the art. Typically, a flexible substrate is provided having an electrically conductive surface. For electrophotographic imaging members, at least one photoconductive layer is applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto an adhesive layer, if present, or directly over the blocking layer, and a charge transport layer is subsequently formed on the charge generation layer. For ionographic imaging members, an electrically insulating dielectric imaging layer is applied to the electrically conductive surface. The substrate contains an anti-curl back coating on the side opposite from the side bearing the charge transport layer or dielectric imaging layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, polysulfones, and the like which are flexible as thin webs. The electrically insulating or conductive substrate should be flexible and in the form of a web, sheet or endless flexible belt. Preferably, the substrate comprises a commercially available biaxially oriented polyester known as Mylar, available from E. I. du Pont de Nemours & Co. or Melinex available from ICI Americas, Inc. or Hostaphan, available from American Hoechst Corporation.

The thickness of the substrate layer depends on numerous factors, including beam strength and economical considerations, and thus this layer for a flexible belt may be of substantial thickness, for example, about 175 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a transparent copper iodide (CuI) or a conductive carbon black dispersed in a plastic binder as an opaque conductive layer.

After formation of an electrically conductive surface, a charge blocking layer may be applied thereto or the anticurl back coating layer of this invention may be applied to the opposite side of the substrate. The anticurl back coating of this invention is applied to the rear side of the substrate (opposite the side bearing the other coatings) to provide flatness and abrasion resistance. These anti-curl back coating layers may be formed on the substrate layer prior to or subsequent to application of one or more coatings applied to the opposite side of the substrate. Because the cured anticurl coatings of this invention are impervious to the solvents used in coating the other layers, the anticurl coating can be coated on the substrate first whereby the expense due to yield losses is minimized compared to the scrapping of photoreceptor materials which also contain all the other coatings on the side of the substrate opposite the anticurl layer, this latter situation occurring if the anticurl layer is applied last.

Any suitable cross linkable film forming alcohol soluble polyamide polymer may be employed in the anticurl back coating of this invention. The anticurl back coating may comprise one or more layers of different materials so long as the outermost layer comprises the cross linked polyamide polymer. Amongst all polyamides there are two classes: a first class of alcohol polyamides containing methoxymethyl groups and a second class of polyamides other alcohol soluble polyamides free of methoxymethyl groups. Any suitable formaldehyde generating cross linking agent, alkoxylated cross linking agent, methylolamine cross linking agent or mixtures thereof may be utilized for enhancing cross linking of the first class of alcohol soluble polyamides containing methoxymethyl groups. Typical formaldehyde generating materials include, for example, trioxane, 1,3-dioxolane, dimethoxymethane, hydroxymethyl substituted melamines, formalin, and the like. The expression "formaldehyde generating material" as employed herein is defined as a source of latent formaldehyde or methylene dioxy or hydroxy methyl ether groups.

Typical alkoxylated cross linking agents are alkoxylated include, for example, hexamethoxymethyl melamine (e.g. Cymel 303), dimethoxymethane (methylal), methoxymethyl melamine, butyl etherified melamine resins, methyl etherified melamine resins, methyl-butyl etherified melamine resins and methyl-isobutyl etherified melamine resins and the like. The expression "alkoxylated cross linking agents" as employed herein is defined as cross linking agents with alkoxyalkyl functional groups. An alkoxyalkyl groups may be represented ROR'—wherein R is an alkyl group containing from 1 to 4 carbon atoms and R' is an alkylene or isoalkylene group containing from 1 to 4 carbon atoms. A preferred alkoxylated cross linking agent is hexamethoxymethyl melamine represented by the formula:

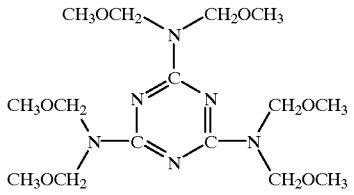

The expression "methylolamine cross linking agents" as employed herein is defined as cross linking agents with >N—$CH_2OH$ functional groups. Typical methylolamine cross linking agents include, for example, trimethylolmelamine, hexamethylolmelamine, and the like. Methylolamine cross linking agents may be prepared, for example, by mixing melamine and formaldehyde in a reaction vessel in the proper ratios under the correct conditions to form a methylol melamine which contains —N—$CH_2OH$ groups. A typical methylolamine is hexamethylolmelamine represented by the following structure:

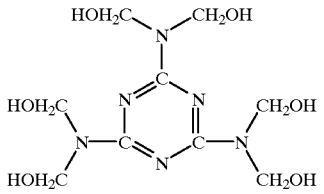

These methylol products can be alkoxylated to form alkoxylated melamines [e.g., methoxylmethylmelamine]. Thus, condensation products of melamine and formaldehyde are precursors for methoxymethylated materials. Hexamethylolmelamine will function in a similar cross-linking manner as hexamethoxymethylmelamine.

Alkoxylated cross linking agents and methylolamine cross linking agents are commercially available. Typical commercially available cross linking agents include, for example, amine derivatives such as hexamethoxymethyl melamine, and/or condensation products of an amine, e.g. melamine, diazine, urea, cyclic ethylene urea, cyclic propylene urea, thiourea, cyclic ethylene thiourea, aziridines, alkyl melamines, aryl melamines, benzo guanamines, guanamines, alkyl guanamines and aryl guanamines, with an aldehyde, e.g. formaldehyde. A preferred cross-linking agent is the condensation product of melamine with formaldehyde. The condensation product may optionally be alkoxylated. The weight average molecular weight of the cross-linking agent is preferably less than 2000, more preferably less than 1500, and particularly in the range from 250 to 500. Commercially available cross linking agents include, for example, CYMEL 1168, CYMEL 1161, and CYMEL 1158 (available from CYTEC Industries, Inc., Five Garret Mountain Plaza, West Paterson, N.J. 07424); RESIMENE 755 and RESIMENE 4514 (available from Monsanto Chemical Co.); butyl etherified melamine resins (butoxymethylmelamine resins) such as U-VAN 20SE-60 and U-VAN 225 (available from Mitsui Toatsu Chemicals Inc.) and SUPERBECKAMINE G840 and SUPERBECKAMINE G821 (available from Dainippon Ink & Chemicals, Inc.); methyl etherified melamine resins (methoxymethyl melamine resins) such as CYMEL 303, CYMEL 325, CYMEL 327, CYMEL 350 and CYMEL 370 (available form Mitsui Cyanamide Co., Ltd.), NIKARAK MS17 and NIKARAK MS15 (available from Sanwa Chemicals Co., Ltd.), Resimene 741 (available from Monsanto Chemical Co., Ltd.) and SUMIMAL M-100, SUMIMAL M-40S and SUMIMAL M55 (available from Sumitomo Chemical Co., Ltd.); methyl-butyl etherified melamine resins (methoxy/butoxy methylmelamines) such as CYMEL 235, CYMEL 202, CYMEL 238, CYMEL 254, CYMEL 272 and CYMEL 1130 (available from Mitsui Cyanamide Co., Ltd.) and SUMIMAL M66B (available from Sumitomo Chemical Co., Ltd.); and methyl-isobutyl etherified melamine resins (methoxy/isobutoxy melamine resins). such as CYMEL XV 805 (available from Mitsui Cyanamide Co., Ltd.) and NIKARAK MS 95 (available from Sanwa Chemical Co., Ltd.). Still other alkoxylated melamine resins such as methylated melamine resins include CYMEL 300, CYMEL 301 and CYMEL 350 (available from American Cyanamid Company).

The formaldehyde generating material such as trioxane in the coating composition serves to cross link the crosslinkable alcohol soluble polyamide containing methoxy methyl groups attached to amide nitrogen atoms. Preferably the coating composition comprises between about 5 percent by weight and about 10 percent by weight trioxane based on the total weight of the crosslinkable alcohol soluble polyamide containing methoxy methyl groups attached to amide nitrogen atoms. The combination of oxalic acid and trioxane facilitates cross linking of the polyamide at lower temperatures. Although all polyamides are alcohol soluble, all polyamides are normally not cross linkable. However, with special materials such as alkoxylated cross linking agents (e.g., Cymel 303) or methylolamine cross linking agents, all polyamides can be cross linkable.

A preferred methoxymethyl generating material is hexamethoxymethylmelamine which serves as a cross linking agent for the polyamide. Hexamethoxymethylmelamine may be represented by the following structure:

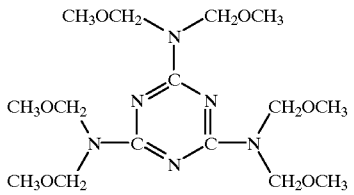

Hexamethoxymethylmelamine is available commercially, for example, Cymel 303, from CYTEC Industries Inc., W. Patterson, N.J. Preferably the coating composition comprises between about 1 percent by weight and about 50 percent by weight hexamethoxymethylmelamine based on the total weight of polyamide. When less than about 1 percent by weight hexamethoxymethylmelamine is used, the cross-linking efficiency is too low. When greater than about 50 percent by weight hexamethoxymethylmelamine is used, the resulting films are highly plasticized.

For the second class of alcohol soluble polyamides free of methoxymethyl groups, a methoxymethyl generating material can be used to enhance the cross-linking. Any suitable methoxymethyl generating material may be utilized for enhancing cross linking of the second class of alcohol soluble polyamides free methoxymethyl groups. Typical methoxymethyl generating material include the same methoxymethyl generating materials described above with reference to enhance cross-linking of first class of alcohol soluble polyamides containing methoxymethyl groups.

A preferred polyamide for the first solution comprises a cross linkable alcohol soluble polyamide polymers having methoxy methyl groups attached to the nitrogen atoms of amide groups in the polymer backbone prior to cross linking is selected from the group consisting of materials represented by the following formulae I and II:

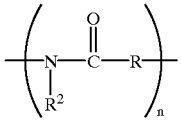

wherein:

n is a positive integer,

R is independently selected from the group consisting of alkylene, arylene or alkarylene units, between 1 and 100 percent of the $R^2$ sites are —H, and the remainder of the $R^2$ sites are —$CH_2$—O—$CH_3$ and

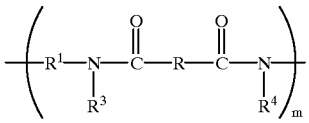

wherein:

m is a positive integer, $R^1$ and R are independently selected from the group consisting of alkylene, arylene or alkarylene units, between 1 and 100 percent of the $R^3$ and $R^4$ sites are —H, and the remainder of the $R^3$ and $R^4$ sites are —$CH_2$—O—$CH_3$.

In the above formula, the methoxy groups participate in cross linking while the added sources of formaldehyde accelerate the cross-linking rate and the sources of methoxymethyl groups (e.g., Cymels) cross-link the polyamide chains further by reacting with the unsubstituted —N—H groups. In the presence of acids and elevated temperatures, these methoxy methyl groups in the first class of polyamides containing methoxy methyl groups attached to amide nitrogen atoms are hydrolyzed to (methylol groups) which decompose to form cross linked polymer chains and methanol byproduct. The addition of a cross linking agent selected from the group comprising a formaldehyde generating cross linking agent, an alkoxylated cross linking agent, a methylolamine cross linking agent and mixtures thereof accelerate the cross-linking rates. These polyamides should form solid films if dried prior to cross linking. The polyamide should also be soluble, prior to cross-linking, in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to cross linking include, for example, hole insulating alcohol soluble polyamide film forming polymers include, for example, Luckamide 5003 from Dai Nippon Ink, Nylon 8 with methylmethoxy pendant groups, CM4000 from Toray Industries, Ltd. and CM8000 from Toray Industries, Ltd. and other N-methoxymethylated polyamides, such as those prepared according to the method described in Sorenson and Campbell "Preparative Methods of Polymer Chemistry" second edition, pg 76, John Wiley & Sons Inc. 1968, and the like and mixtures thereof. These polyamides can be alcohol soluble, for example, with polar functional groups, such as methoxy, ethoxy and hydroxy groups, pendant from the polymer backbone.

A preferred polyamide for the second solution comprises a crosslinkable alcohol soluble polyamide free of methoxy methyl groups attached to amide nitrogen atoms prior to cross linking is represented by the following formulae I and II:

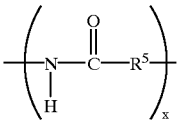

wherein:

x is a positive integer, $R^5$ is independently selected from the group consisting of alkylene, arylene or alkarylene units, and

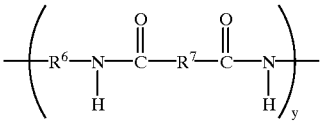

wherein:

y is a positive integer, and $R^6$ and $R^7$ are independently selected from the group consisting of alkylene, arylene or alkarylene units.

Typical alcohol soluble polyamide polymers free of methoxy methyl groups attached to the nitrogen atoms of amide groups in the polymer backbone prior to cross linking include, for example, Elvamides from DuPont de Nemours & Co., and the like. These polyamides should form solid films if dried prior to cross linking. Elvamide® is a product of the DuPont de Nemours & Co. and is a random terpolymer of nylon 6, nylon 6,6, and nylon 6,12. These polyamides can be alcohol soluble, for example, with polar functional groups, such as methoxy, ethoxy and hydroxy groups, pendant from the polymer backbone. By the addition of an alkoxylated cross linking agent, a methylolamine cross linking agent and mixtures thereof (e.g., Cymels) cross-linked polyamides can be obtained under suitable acidic conditions and thermal cures. Generally, the dried and cured anticurl back coating layer comprises between about 30 percent by weight and about 70 percent by weight polyamide, based on the total weight of anticurl back coating layer after drying and curing.

The structures shown below are representative starting materials and representative abrasion resistant cross linked compositions that are formed. Although only two polymeric cross linked bonds are shown in the representative structures, each cross linker has the capacity to form six cross linked sites.

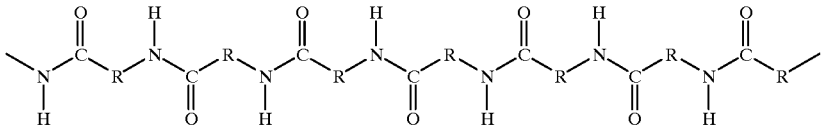

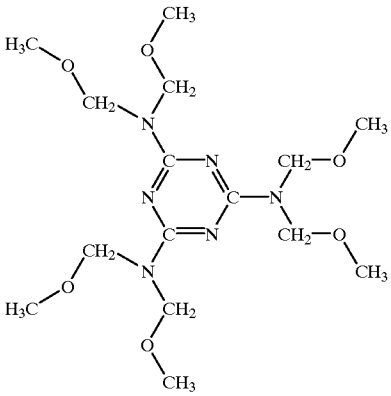

Hexamethoxymethylmelamine Structure

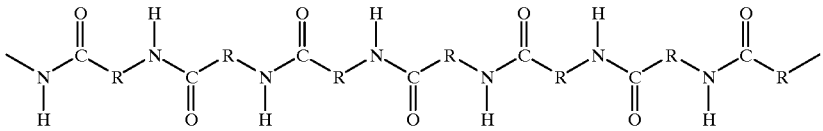

Elvamide Type Structure

-continued

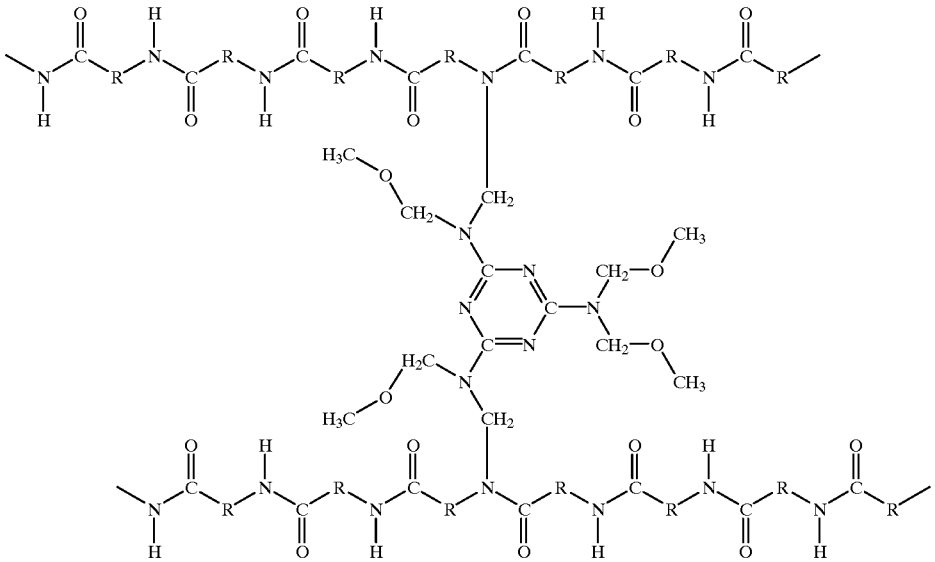

Crosslinked Elvamide Type Structure

Since the film forming polyamides are also soluble in a solvent, they can be readily coated by conventional coating techniques. Typical solvents include, for example, butanol, methanol, butyl acetate, ethanol, cyclohexanone, tetrahydrofuran, methyl ethyl ketone, and the like and mixtures thereof. Typical diluents include, for example, 1,3 dioxolane, tetrahydrofuran, chlorobenzene, fluorobenzene, methylene chloride, and the like and mixtures thereof.

Generally, sufficient cross linking agent should be added to the coating composition to achieve cross linking at least by the time drying of the coating is completed. Typical amounts of cross linking agent range from about 1 percent by weight and 30 percent by weight based on the weight of the polyamide.

Cross linking is accomplished by heating in the presence of a catalyst. Any suitable catalyst may be employed. Typical catalysts include, for example, oxalic acid, p-toluenesulfonic acid, methanesulfonic acid, maleic acid, phosphoric acid, hexamic acid and the like and mixtures thereof. These acids have a $pK_a$ of less than about 3, and more preferably, between about 0 and about 3. Catalysts that transform into a gaseous product during the cross linking reaction are preferred because they escape the coating mixture and leave no residue that might adversely affect the electrical properties of the final anticurl back coating. A typical gas forming catalyst is, for example, oxalic acid. The temperature used for cross linking varies with the specific catalyst and heating time utilized and the degree of cross linking desired. Generally, the degree of cross linking selected depends upon the desired flexibility of the final photoreceptor. For example, complete cross linking may be used for rigid drum or plate photoreceptors. However, partial cross linking is preferred for flexible photoreceptors and the desired degree of cross linking will vary depending on, for example, web or belt configurations. The degree of cross linking can be controlled by the relative amount of catalyst employed and the amount of specific polyamide, cross linking agent, catalyst, temperature and time used for the reaction. A typical cross linking temperature used for Luckamide with oxalic acid as a catalyst is about 125° C. for 30 minutes. After cross linking, the anticurl back coating having the cross linked polyamide at the exposed surface thereof should be substantially insoluble in the solvent in which it was soluble prior to cross linking. Thus, no anticurl back coating material will be removed when rubbed with a cloth soaked in the solvent. This solvent resistance is characteristic of an anticurl back coating comprising only the polyamide or an anticurl back coating containing a plurality of different layers where the outermost layer having an exposed surface contains the polyamide. Any anticurl back coating layer underlying the polyamide layer should be compatible with the polyamide material so that it is not degraded during the application of the polyamide layer.

The acid in the coating composition serves to cross link the polyamide. The anticurl back coating layer is transparent to exposure light (imagewise activating radiation). Preferably the coating composition comprises between about 6 percent by weight and about 15 percent by weight acid based on the total weight of polyamide, the acid having a $pK_a$ of less than about 3 and, more preferably, between about 0 and about 3. A preferred acid is oxalic acid. When less than about 6 percent by weight acid is used, the polyamide is not completely cross linked.

Generally, the soluble components of the anticurl back coating layer coating mixture are mixed in a suitable solvent or mixture of solvents prior to the addition of the charge injecting particles. Any suitable solvent may be utilized. Preferably the solvent is methanol, ethanol, propanol, and the like and mixtures thereof. The solvent selected should not adversely affect the underlying layer, whether it is another layer of different material making up the anticurl backing layer or another layer of the photoreceptor such as the substrate layer. For example, the solvent selected should not dissolve or crystallize the underlying photoreceptor. The relative amount of solvent employed depends upon the specific materials and coating technique employed to fabricate the anticurl back coating layer. Typical ranges of solids include, for example, between about 5 percent by weight to about 40 percent by weight soluble solids. Preferably, the finely divided inorganic and/or organic particles are dispersed in a solution of the cross linkable polyamide.

The components of the anticurl back coating layer may be mixed together by any suitable conventional means. Typical mixing means include stirring rods, ultrasonic vibrators, magnetic stirrers, paint shakers, sand mills, roll pebble mills, sonic mixers, melt mixing devices and the like. After mixing the inorganic and/or organic particles, if employed, in the solution of solvent soluble components such as the cross linkable polyamide to form a coating mixture containing a dispersion of the particles, the coating mixture is applied to the photoreceptor by any suitable coating process. As indicated above, all the components of the anticurl back coating layer or layers of this invention except the optional inorganic and/or organic particles are solvent soluble. Typical coating techniques include spraying, draw bar coating, dip coating, gravure coating, silk screening, air knife coating, reverse roll coating, extrusion techniques, wire wound rod coating, and the like.

The thickness of anticurl back coating layers should be sufficient to substantially balance the total curling forces of the layer or layers on the opposite side of the supporting substrate layer. Typical anticurl back coating layer total thickness, whether a mono-layer or multiple layers, are between about 2 micrometers and about 50 micrometers. Where the anticurl back coating layer comprises a plurality of layers, the outermost layer having an exposed surface should comprise the cross linked polyamide and should have a thickness of at least about 2 micrometers. The total thickness of the anticurl back coating layer or anticurl back coating layers should be sufficient to prevent curl of the photoreceptor. The specific thickness will vary depending upon the specific materials and thickness employed for the layers on the side of the substrate layer opposite the anticurl back coating layer or layers.

Drying and curing of the deposited anticurl back coating layer may be accomplished by any suitable technique. Typical drying techniques include, for example, oven drying, infrared radiation drying, air drying and the like. Upon completion of drying and curing, the polyamide in the anticurl back coating layer is cross linked and insoluble in alcohol. Generally, where other anticurl back coating layers are employed under the polyamide layer, these underlying layers are preferably dried by conventional drying techniques prior to application of the polyamide layer.

As described above, the anticurl cross linked polyamide back coating is coated as the only anticurl back coating layer or as an outermost layer of a plurality of anticurl back coating layers. Where the cross linked polyamide is coated on top of another different material to fabricate a multilayered anticurl back coating layer, the underlying anticurl back coating layers may comprise any suitable conventional anticurl back coating layer material. These conventional anticurl back coating layers may also contain organic or inorganic fillers. Typical conventional anticurl back coating layer materials include, for example, polycarbonate, polyester, and the like. The material selected for any underlying back coating layer should not be degraded by the application of the polyamide back coating layer.

An optional charge blocking layer may be applied to the electrically conductive surface prior to or subsequent to application of the anticurl backing layer to the opposite side of the substrate. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. No. 4,338,387, U.S. Pat. No. 4,286,033 and U.S. Pat. No. 4,291,110. The disclosures of these patents are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thickness may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E. I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetatevinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thickness outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound. Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive thermoplastic resin binder soluble in methylene chloride or other suitable solvent may be employed in the process of this invention to form the thermoplastic polymer matrix of the imaging member. Typical inactive resin binders soluble in methylene chloride include polycarbonate resin, polyvinylcarbazole, polyester, polyarylate, polyacrylate, polyether, polysulfone, polystyrene, polyamide, and the like. Molecular weights can vary from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

If desired, a charge transport layer may comprise electrically active resin materials instead of or mixtures of inactive resin materials with activating compounds. Electrically active resin materials are well known in the art. Typical electrically active resin materials include, for example, polymeric arylamine compounds and related polymers described in U.S. Pat. No. 4,801,517, U.S. Pat. No. 4,806,444, U.S. Pat. No. 4,818,650, U.S. Pat. No. 4,806,443 and U.S. Pat. No. 5,030,532. Polyvinylcarbazole and derivatives of Lewis acids described in U.S. Pat. No. 4,302,521. Electrically active polymers also include polysilylenes such as poly(methylphenyl silylene), poly(methylphenyl silylene-co-dimethyl silylene), poly(cyclohexylmethyl silylene), poly(tertiarybutylmethyl silylene), poly(phenylethyl silylene), poly(n-propylmethyl silylene), poly(p-tolylmethyl silylene), poly(cyclotrimethylene silylene), poly (cyclotetramethylene silylene), poly(cyclopentamethylene silylene), poly(di-t-butyl silylene-co-di-methyl silylene), poly(diphenyl silylene-co-phenylmethyl silylene), poly (cyanoethylmethyl silylene) and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516. The disclosures of each of the patents identified above pertaining to binders having charge transport capabilities are incorporated herein by reference in their entirety.

Other layers such as conventional electrically conductive ground strip along one edge of the belt in contact with the conductive layer, blocking layer, adhesive layer or charge generating layer to facilitate connection of the electrically conductive layer of the photoreceptor to ground or to an electrical bias. Ground strips are well known and comprise usually comprise conductive particles dispersed in a film forming binder.

An overcoat layer may also be utilized to protect the charge transport layer and improve resistance to abrasion. These overcoat layers are well known in the art and may comprise thermoplastic organic polymers or inorganic polymers that are electrically insulating or slightly semiconductive.

For electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member. If desired, the flexible belts of this invention may be used for other purposes where cycling durability is important.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Four photoreceptors were prepared by forming coatings using conventional techniques on a substrate comprising vacuum deposited titanium layer on a polyethylene terephthalate film. The first coating was a siloxane barrier layer formed from hydrolyzed gamma-aminopropyltriethoxysilane having a thickness of 0.005 micrometer (50 Angstroms). The barrier layer coating composition was prepared by mixing 3-aminopropyltriethoxysilane (available from PCR Research Center Chemicals of Florida) with ethanol in a 1:50 volume ratio. The coating composition was applied by a multiple clearance film applicator to form a coating having a wet thickness of 0.5 mil. The coating was then allowed to dry for 5 minutes at room temperature, followed by curing for 10 minutes at 110 degrees Centigrade in a forced air oven. The second coating was an adhesive layer of polyester resin (49,000, available from E. I. duPont de Nemours & Co.) having a thickness of 0.005 micrometer (50 Angstroms). The second coating composition was applied using a 0.5 mil bar and the resulting coating was cured in a forced air oven for 10 minutes. This adhesive interface layer was thereafter coated with a photogenerating layer containing 40 percent by volume hydroxygallium phthalocyanine and 60 percent by volume of a block copolymer of styrene (82 percent)/4-vinyl pyridine (18 percent) having a $M_w$ of 11,000. This photogenerating coating composition was prepared by dissolving 1.5 grams of the block copolymer of styrene/4-vinyl pyridine in 42 mL of toluene. To this solution was added 1.33 grams of hydroxygallium phthalocyanine and 300 grams of ⅛ inch diameter stainless steel shot. This mixture was then placed on a ball mill for 20 hours. The resulting slurry was thereafter applied to the adhesive interface with a Bird applicator to form a layer having a wet thickness of 0.25 mil. This layer was dried at 135° C. for 5 minutes in a forced air oven to form a photogenerating layer having a dry thickness 0.4 micrometer. The next applied layer was a transport layer which was formed by using a Bird coating applicator to apply a solution containing one gram of N,N'-diphenyl-N,N'-bis(3-methyl-phenyl)-(1,1'-biphenyl)-4,4'-diamine (TPD) and one gram of polycarbonate resin poly(4,4'-isopropylidene-diphenylene carbonate) (available as Makrolon® from Farbentabricken Bayer A.G.) dissolved in 11.5 grams of methylene chloride solvent. The N,N'-diphenyl-N,N'-bis(3-methyl-phenyl)-(1,1'-biphenyl)-4,4'-diamine (TPD) is an electrically active aromatic diamine charge transport small molecule whereas the polycarbonate resin is an electrically inactive film forming binder. Each coated device was dried at 80° C. for half an hour in a forced air oven to form a dry 25 micrometer thick charge transport layer. A 17 micrometer thick anticurl layer of polycarbonate resin poly(4,4'-isopropylidene-diphenylene carbonate) (available as Makrolo® from Farbenfabricken Bayer A.G.) was coated on the back side of the polyethylene terephthalate substrate using a 4 mil Bird bar and a solution containing 100 grams Makrolon in 1 Kg methylene chloride. The device was heated at 80° C. for half an hour.

EXAMPLE II

A layer of cross linked Elvamide was coated on top of the anticurl polycarbonate layer of Example I to form a multilayered anticurl layer. The Elvamide anticurl back coating layer coating composition was prepared by dissolving 1 gram of Elvamide 8063 (cross linkable polyamide available from duPont de Nemours & Co.) in 7 grams methanol at 45° C.–50° C. To this polymer solution was added 0.2 gram of oxalic acid, 0.2 gram Cymel 303, available from Cytec Industries Inc., and 0.01 gram polydimethylsiloxane (MCR-B11 from Gelest Inc.). This solution was then coated onto the coated samples described above using a 1 mil Bird bar. The resulting coated samples were placed in a forced air oven at 110° C. for three minutes. The resulting 7 micrometers thick cross linked Elvamide coating was impervious to methanol and unaffected by vigorous abrasion.

EXAMPLE III

A layer of cross linked Luckamide was coated on top of the polycarbonate anticurl back coating layer of Example I to form a multilayered anticurl layer. The Elvamide anticurl back coating layer coating composition was prepared by dissolving 1 gram of purified Luckamide (cross linkable polyamide available from Dai Nippon Ink) was dissolved in 6 grams of methanol at 45° C.–50° C. To this polymer solution was added, 0.1 gram oxalic acid, and 0.2 gram trioxane and 0.01 gram polydimethylsiloxane (MCR-B11 from Gelest Inc.). This mixture was then coated onto the fabricated samples described above using a 1 mil Bird bar. The resulting coated samples were placed in a forced air oven (FAO) at 110° C. for three minutes. The cross linked Luckamide coating had a thickness of 7 micrometers, was impervious to methanol and was unaffected by vigorous abrasion. When 0.2 g of oxalic acid is used, cross linking in less than 2 minutes is achievable. Cross linking of Luckamide is enhanced by the addition of trioxane, a source of formaldehyde. The function of the formaldehyde is ascribed to the production of n-methylol groups in the Luckamide backbone which condense to form cross links.

Thus, cross linking occurs by two mechanisms:

1. Methylol group, —N—$CH_2$—OH to —N—H group condensation.
2. N-methoxymethyl group to —N—H group condensation.

These structures are shown below:

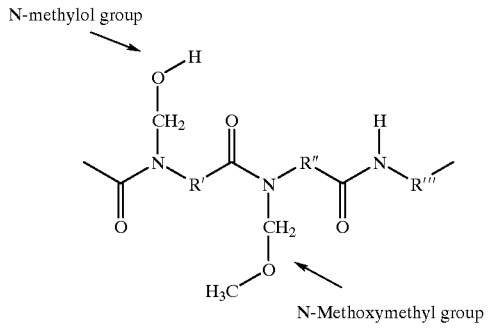

The following reaction represents the cross linking of the materials of this Example:

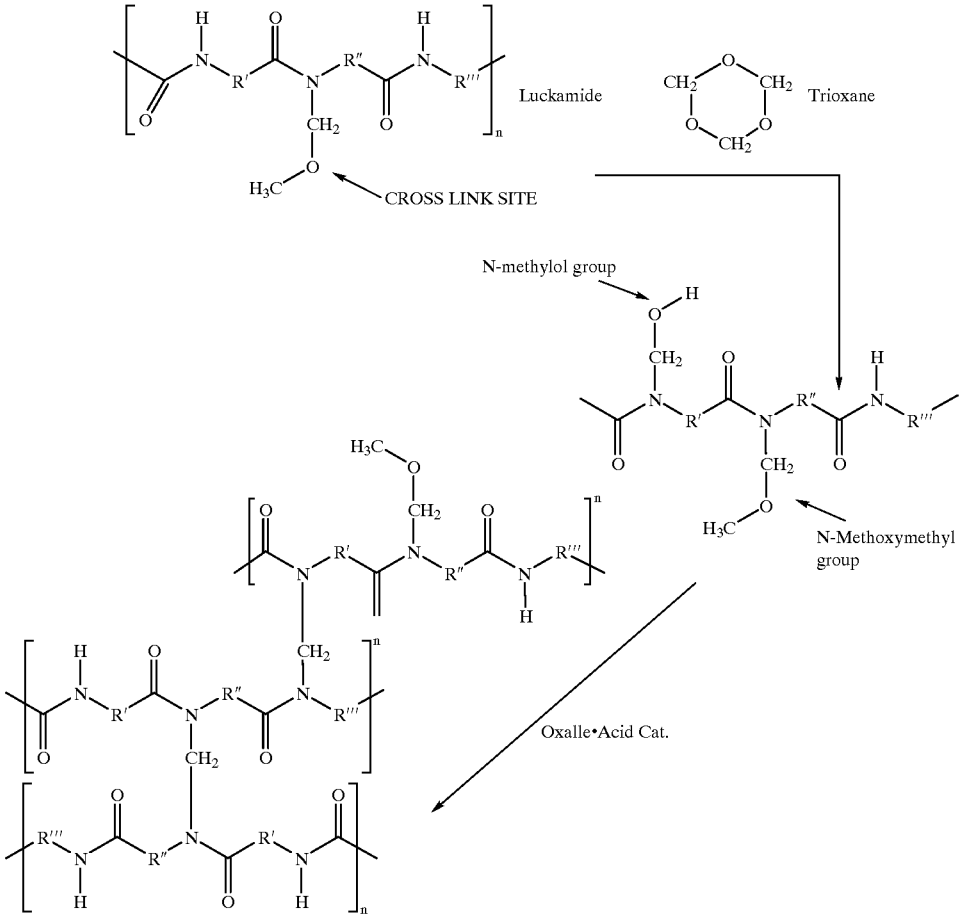

EXAMPLE IV

A layer of cross linked Luckamide was coated on top of the anticurl polycarbonate layer of Example I to form a multilayered anticurl layer. The Luckamide anticurl back coating layer coating composition was prepared by dissolving 1 gram of purified Luckamide in 6 grams of methanol at 45° C.–50° C. To this polymer solution was added 0.1 gram of oxalic acid, 0.2 gram of Cymel 303 and 0.01 gram polydimethylsiloxane (MCR-B11 from Gelest Inc.). This mixture was then coated onto the coated samples described above using a 1 mil Bird bar. The sample sheet was cut in half, and one half was placed in a FAO at 100° C. The added anticurl back coating required approximately 5 minutes to become fully cross linked. The other half was placed in a FAO at 110° C. and was fully cross linked within 2 minutes and had a thickness of 7 micrometers.

Representative formulae for the components used in this Example are shown below:

Cross linking of the materials of this Example is accomplished at two chemically different sites:

1. The —N—$CH_2$—O—$CH_3$ group of the polyamide (Nylon) reacts with a —N—H unit in a neighboring polyamide.
2. The Cymel 303 reacts with the —N—H units in as many as six polyamide chains.

These cross links are shown below:

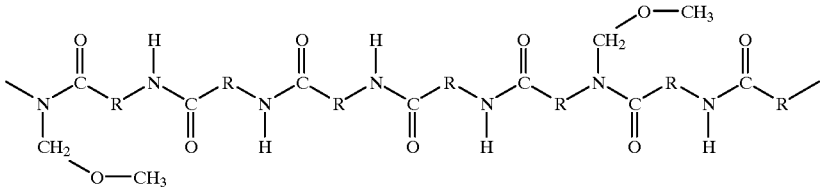

Luckamide Type Structure

Melamine Crosslinker

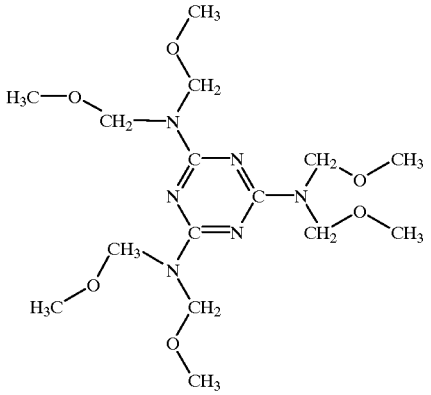

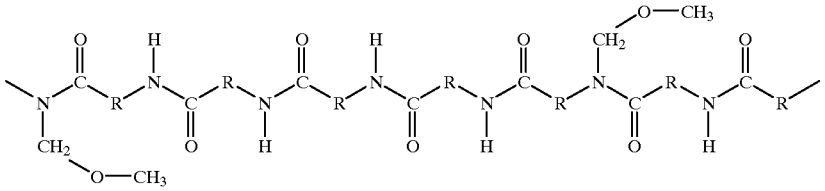

Luckamide Type Structure

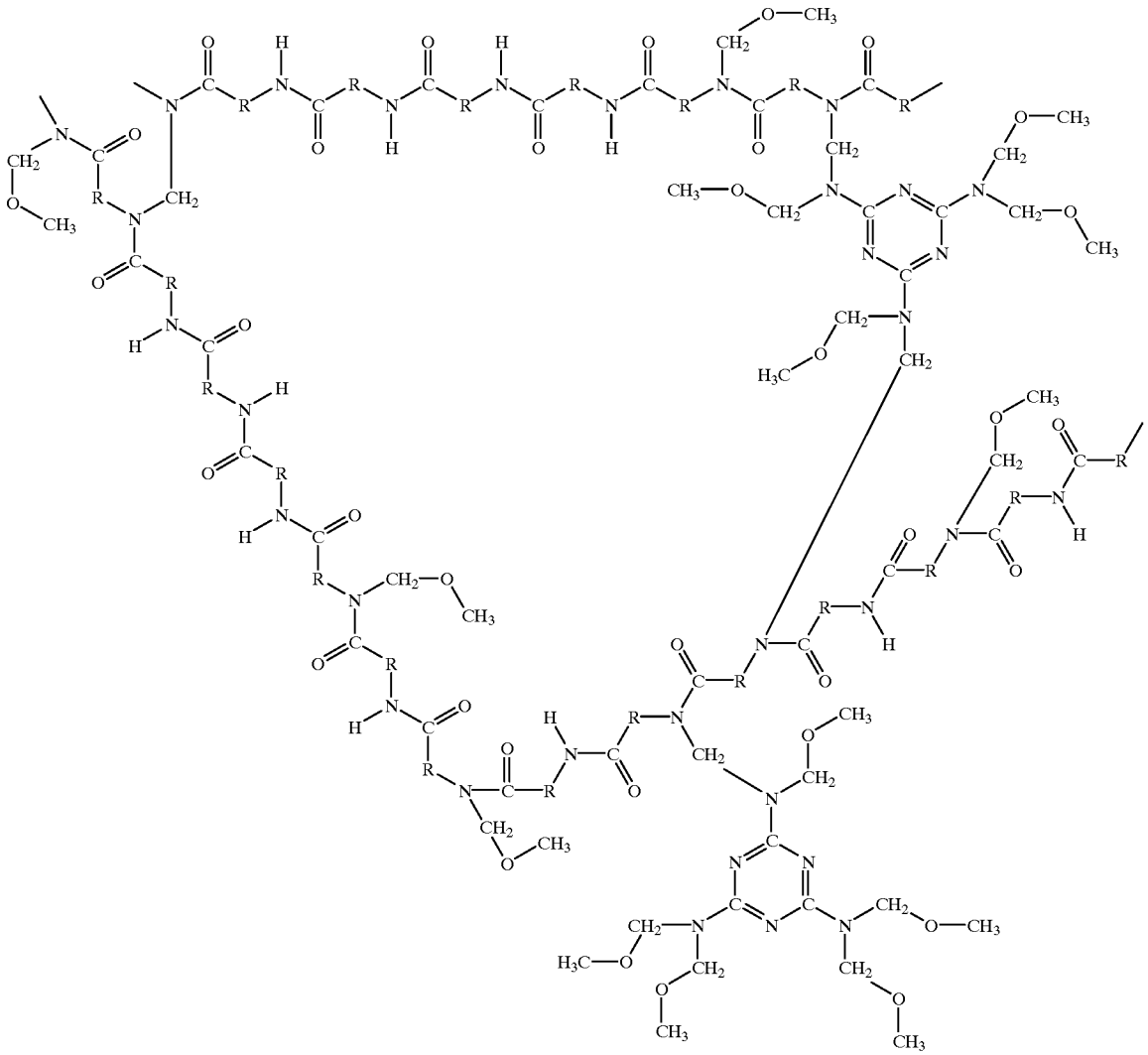

EXAMPLE V

The samples of Example I, II, III and IV were cycled for 100,000 cycles on a tri-roller fixture equipped with six non-revolving, 1 inch diameter rollers, each roller being anodized to simulate anodized backer bars utilized in copiers and duplicators. The anticurl back coating layer of Example I had a wear of 6 micrometers; the multilayered anticurl back coating structure of Example II had a wear of 0.2 micrometers; the multilayered anticurl back coating of Example III had a wear of 2 micrometers; and the multilayered anticurl back coating of Example IV had a wear of 1.5 micrometers in 100,000 cycles.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A flexible electrostatographic imaging member comprising at least one photographic imaging layer, a support layer, and an anticurl back layer having an exposed surface comprising a cross linked polyamide at the exposed surface, the polyamide being, formed from a solution selected from the group comprising a first solution comprising crosslinkable alcohol soluble polyamide containing methoxy methyl groups attached to amide nitrogen atoms, an acid having a $pK_a$ less than about 3, a cross linking agent selected from the group comprising a formaldehyde generating cross linking agent, an alkoxylated cross linking agent, a methylolamine cross linking agent and mixtures thereof, and a liquid selected from the group comprising alcohol solvents, diluent and mixtures thereof, a second solution comprising crosslinkable alcohol soluble polyamide free of methoxy methyl groups attached to amide nitrogen atoms, an acid having a $pK_a$ less than about 3, a cross linking agent selected from the group comprising a an alkoxylated cross linking agent, a methylolamine cross linking agent and mixtures thereof, and a liquid selected from the group comprising alcohol solvents, diluent and mixtures thereof.

2. A flexible electrostatographic imaging member according to claim 1 wherein the cross linkable alcohol soluble polyamide containing methoxy methyl groups attached to amide nitrogen atoms is selected from the group consisting of materials represented by the following formulae I and II:

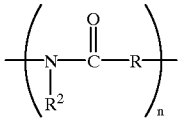

wherein:

n is a positive integer,

R is independently selected from the group consisting of alkylene, arylene or alkarylene units, between 1 and 99 percent of the $R^2$ sites are —H, and the remainder of the $R^2$ sites are —$CH_2$—O—$CH_3$ and

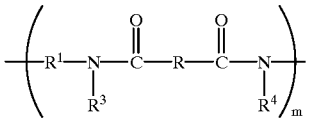

wherein:

m is a positive integer, $R^1$ and R are independently selected from the group consisting of alkylene, arylene or alkarylene units, between 1 and 99 percent of the $R^3$ and $R^4$ sites are —H, and the remainder of the $R^3$ and $R^4$ sites are —$CH_2$—O—$CH_3$.

3. A flexible electrostatographic imaging member according to claim 1 wherein the crosslinkable alcohol soluble polyamide free of methoxy methyl groups attached to amide nitrogen atoms is represented by the following formula:

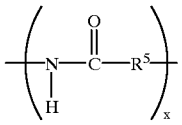

wherein:

x is a positive integer, $R^5$ is independently selected from the group consisting of alkylene, arylene or alkarylene units, and

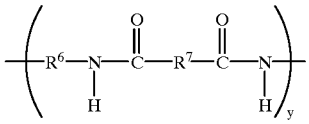

wherein:

y is a positive integer, and $R^6$ and $R^7$ are independently selected from the group consisting of alkylene, arylene and alkarylene units.

4. A flexible electrostatographic imaging member according to claim 1 wherein the anticurl back layer has a thickness between about 2 micrometer and about 50 micrometers.

5. A flexible electrostatographic imaging member according to claim 1 wherein the acid is oxalic acid.

6. A flexible electrostatographic imaging member according to claim 1 wherein the acid is toluenesulfonic acid.

7. A flexible electrostatographic imaging member according to claim 1 wherein the acid is methanesulfonic acid.

8. A flexible electrostatographic imaging member according to claim 1 wherein the anticurl back layer is a multilayered anticurl back layer comprising a polycarbonate and a layer comprising the cross linked polyamide.

* * * * *